United States Patent [19]

Iwai et al.

[11] Patent Number: 4,825,522

[45] Date of Patent: May 2, 1989

[54] METHOD OF MAKING HEAT RESISTANT HEAVY-DUTY COMPONENTS OF A TURBINE BY SUPERPLASTICITY FORGING WHEREIN DIFFERENT ALLOYS ARE JUNCTIONED

[75] Inventors: Kenji Iwai; Seiya Furuta, both of Kobe; Hiroshi Takigawa; Nobuyasu Kawai, both of Kyobe, all of Japan

[73] Assignee: Director General of the Agency of Industrial Science and Technology, Tokyo, Japan

[21] Appl. No.: 102,402

[22] Filed: Sep. 29, 1987

[30] Foreign Application Priority Data

Aug. 12, 1987 [JP] Japan ..... 62-199938

[51] Int. Cl.[4] ..... B21K 3/00

[52] U.S. Cl. ..... 29/156.8 R; 29/23.5; 29/527.1

[58] Field of Search ..... 29/156.8 R, 156.8 CF, 29/156.8 FC, 156.8 B, 156.8 H, 156.8 P, 156.8 T, 527.1, 505, 23.5; 148/11.5 N, 11.5F, 11.5 P; 416/241 R; 415/212 A

[56] References Cited

U.S. PATENT DOCUMENTS 3,519,503 7/1970 Moore ..... 148/11.5 F
4,081,295 3/1978 Vogel ..... 148/11.5 N
4,479,293 10/1984 Miller et al. ..... 29/156.8 R
4,479,833 10/1984 Gessinger et al. ..... 148/11.5 N X

*Primary Examiner*—Carl E. Hall
*Assistant Examiner*—Irene Cuda
*Attorney, Agent, or Firm*—Oblon, Fisher, Spivak, McClelland & Maier

[57] ABSTRACT

The method concerns fabricating heat-resistant heavy-duty components of a turbine, e.g. disk, wheel, etc. wherein two or more different kinds of alloys are junctioned, which comprises solidifying the one alloy powder by hot isostatic pressing or extrusion, junctioning and solidifying the solidified alloy with the other alloy powder by hot isostatic pressing or extrusion, and subjecting the alloys thus obtained to superplasticity forging thereby to secure the junction boundary. Ni-base superalloys having different complete solid solution temperatures of gamma prime phase are selected for use in the hub and rim of a turbine disk or the like, the one alloy which is higher in the temperature being disposed for the hub and the other alloy for the rim. The difference in the temperature between both alloys is at least 8° C. Further solution heat treatment is performed at a temperature between the complete solid solution temperatures to adjust crystal grain size. Heat-resistant heavy-duty components of a turbine, e.g. disk, etc. are thus fabricated by superplasticity forging from Ni-base superalloys.

1 Claim, 3 Drawing Sheets

METHOD OF MAKING HEAT RESISTANT HEAVY-DUTY COMPONENTS OF A TURBINE BY SUPERPLASTICITY FORGING WHEREIN DIFFERENT ALLOYS ARE JUNCTIONED

BACKGROUND OF THE INVENTION

1. Field of the Invention

This invention relates to heat-resistant heavy-duty components, e.g. a disk, wheel, etc. of gas turbines for aircrafts and generators, and to a method of fabricating the same wherein dissimilar alloys are junctioned. More particularly, it relates to a method of fabricating a turbine disk, etc. by superplasticity forging from two or more kinds of dissimilar alloys having different which method allows enhancing the reliability of the junction interface between the alloys, and to the turbine disk, thus obtained.

2. Statement of Related Art

In gas turbines, higher temperatures have been achieved by an enhancement in the thermal efficiency and rise in their power output but which requires an increase in the number of revolutions more and more. In order to meet this demand, an enhancement of materials in heat-resistant strength and fatigue characteristics is necessary.

In the case of a gas turbine disk and gas turbine wheel, different characteristics are required between the hub and rim portions. Centrifugal force due to high speed revolution is higher in the hub portion than in the rim portion and, consequently, high tensile strength and fatigue strength that are endurable to higher centrifugal force are required more in the hub portion. Conversely, however, the temperature becomes higher from the hub portion toward the rim portion where creep strength is required rather than tensile strength and fatigue strength. From the standpoint of microstructure of materials, a fine structure is necessary more in the hub portion, whereas a coarse crystal grain structure is necessary more in the rim portion. Thus, characteristics required for a disk or wheel vary depending on its portions.

With a view toward optimizing performances of a gas turbine disk, wheel, etc., a variety of methods have been proposed. Typical methods are exemplified as follows:

(1) Method for enhancing creep property of the rim portion by unidirectional recrystallization heat treatment. In a disk solidified by hot isostatic pressing (hereinafter abbreviated as "HIP") from alloy powders, temperature distribution from the rim portion to the hub portion is controlled so that unidirectional recrystallization coarsening from the rim toward the hub may be performed.

(2) Method of subjecting only the hub portion to forging. Reversely to (1) above, in order to enhance tensile property and fatigue property of the hub portion, a powder HIP material only of the hub portion is processed and recrystallized to a fine structure.

(3) Method of fabricating a turbine wheel by diffusion-junctioning a cast ring of blade and a HIP disk. A ring including the rim portion and blade is fabricated by casting to impart a creep property to the ring as a coarse crystal grain structure while a disk as a hub portion is fabricated by HIP to make a fine structure having a high tensile strength and finally, both are diffusion-junctioned by HIP.

(4) Method of HIP simultaneously different kinds of alloy powders. Two kinds of alloys having different characteristics are disposed in respective portions of a disk so that requisite characteristics may be imparted to the respective portions and, simultaneously, subjected to HIP treatment.

(5) Method of diffusion-junctioning a HIP solidified material with a different kind of alloy powder by HIP. To a rim portion preliminarily treated by HIP, a different kind of alloy powder is diffusion-junctioned by HIP to fabricate a hub portion. Here, the HIP temperature in fabricating the hub portion is generally made lower than in the case of the rim portion.

The foregoing methods, however, have problems and defects which follow. More specifically, the methods of (3) to (5) above availing themselves of diffusion junction by HIP are more advantageous than the methods of (1), (2) above in that the costs of manufacture are cheaper, but the methods (3) and (5) are not satsifactory with respect to reliability of the diffusion junction interfaces. Particularly, the method (5) in which the different alloy powder is diffusion-junctioned to the HIP solidified material has not yet provided any satisfactory joint. In the method (4) wherein different alloy powders are subjected to HIP simultaneously, intermingling of them occurs and consequently, junction boundary is difficult to control and devoid of reliability.

SUMMARY OF THE INVENTION

In view of the present situation above, this invention is aimed at an improvement in the foregoing method (5), thus ensuring the reliability in the junction boundary faces and further bringing non-junctioned part into thorough junction by superplasticity forging after HIP junction.

The present invention is designed for fabricating a turbine disk, etc. according to the aforementioned method. To that end, it has proved to be critical to select such alloys that have good junction ability in the fabrication of a forging material and similar superplasticity characteristics upon forging.

Accordingly, this invention provides heat-resistant heavy-duty members, e.g. turbine disk, etc. by selecting a combination of different alloys for a dual property disk or the like which alloys have good junction properties in the fabrication of a forging material and similar superplasticity characteristics with respect to foregeability, and yield high strength characteristics.

That is, according to one aspect, this invention resides in a method of fabricating heat-resistant heavy-duty components, e.g. a turbine disk, turbine wheel, etc. in which two or more kinds of heat-resistant alloys having different characteristics are junctioned which comprises the sequential steps of: solidifying one alloy powder of the foregoing alloys by HIP or extrusion, junctioning and solidifying the other alloy powder or powders to the alloy thus soldified by HIP or extrusion and subjecting both alloys to superplasticity forging thereby to enhance reliability at the junction boundary.

According to another aspect of this invention, there are provided heat-resistant heavy-duty components of a turbine, e.g. disk, wheel, etc. obtained by the foregoing method, whose hub and rim portions are composed of different Ni-base superalloys suited to respective characteristics of the portions.

The method of this invention includes the following embodiments:

(a) Two or more kinds of heat-resistant alloy powders having different characteristics are junctioned and solidified by HIP treatment two or more times, and then, subjected to superplasticity forging thereby to ensure reliabillity of junction boundary faces among the different alloys. The HIP conditions here are such that the solidification, and the junction and solidification can be sufficiently performed and as a result, voids have disappeared completely and a fine crystal grain structure is obtained which facilitates the subsequent superplasticity forging. The HIP temperature is at least necessary to be upward of 1000° C. and not higher than the recrystallization temperature.

Figure 1A:
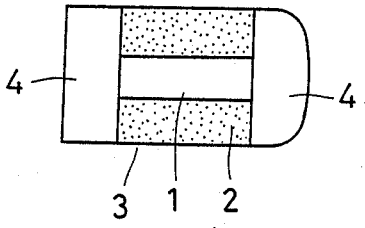
FIG. 1(*a*) and FIG. 1(*b*) are each a sectional view showing an example of extrusion billet.
Figure 1B:
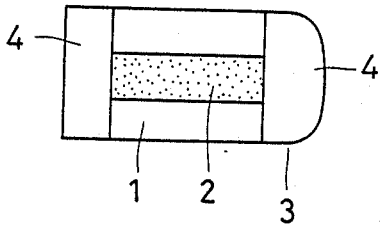

(b) Two or more kinds of heat-resistant alloys having different characteristics are junctioned by extrusion and submitted to superplasticity forging thereby to ensure reliability of the junction boundary faces. The extrusion is performed, as shown in FIG. 1(*a*) and FIG. 1(*b*), by disposing a solidified alloy material 1 and the other different alloy powder 2 in a capsule 3 together with a nose and rear dummy 4 so that the former may be located in the central part of the capsule (cf. FIG. 1(*a*)) or in the peripheral part (cf. FIG. 1(*b*)).

The extrusion conditions are required to be a temperature extending from a recrystallization temperature to 250° C. below the recrystallization temperature and an extrusion ratio of upward of 10 for the same reasons as above (a).

(c) The HIP solidified materials obtained in (a) above are further junctioned by extrusion and then subjected to superplasticity forging thereby to enhance the reliability of junction boundary faces.

The extrusion conditions here are a temperature between the recrystallization temperature and 250° C. below the temperature and an extrusion ratio of upward of 1.0.

In the method of this invention, by the term "superplasticity forging" used herein is meant a forging process which is performed by controlling the temperature and strain velocity conditions and taking advantage of superplasticity of materials. Accordingly, it is essential to select such heat-resistant alloy powders that are easy to perform superplasticity forging. As known well in superplasticity forging technique, such alloys are ncessitated to be of a fine crystal grain structure.

The foregoing forging temperature and strain velocity vary somewhat depending on the kind of alloys, but for a Ni-base superalloy containing at least 30% of Ni, in general, the superplasticity forging temperature is 1000°–1150° C. and the strain velocity is up to $1\times10^{-2}$/S.

Particularly, in fabricating heat-resistant heavy-duty members such as a turbine disk, turbine wheel, etc., it is significantly essential to use alloy powders well suited to respective characteristics of the hub and rim portions of them.

For that purpose, alloys having compositions listed below are used, wherein alloy A is for a hub and alloy B is for a rim.

| Element | Alloy A (Hub) | Alloy B (Rim) |
|---|---|---|
| C | 0.09–0.02 | 0.07–0.02 |
| Cr | 8–12 | 8–12 |
| Co | 6–9 | 13–17 |
| Mo | 1.5–4.5 | 1.5–4.5 |
| W | 2.5–4.5 | 4.5–7.5 |
| Al | 2.8–4.8 | 2.8–4.8 |
| Ti | 1.8–3.8 | 2.8–4.8 |
| Nb | 2.9–4.9 | 1–3 |
| Hf | — | <1.0 |
| B | <0.05 | <0.05 |
| Zr | <0.10 | <0.10 |
| Ni | balance | balance |

The above-mentioned alloys can be HIP treated in an isotropic manner at a temperature of 1050°–1150° C. and a pressure of upward of 1000 kg/cm$^2$ to solidify and junction them, and then, the resulting material is fabricated into a dual property disk, etc.

(d) Subsequently to junctioning and solidification by HIP or extrusion described above, superplasticity forging and solution heat treatment are performed whereby the crystal grain size is adjusted.

For that purpose, alloys to be used are critical to show superplasticity phenomenon and to be superplasticity forgeable as stated above. The fine crystal structure required for superplasicity forging can be obtained by subjecting finely divided powders of up to 105 μm to HIP treatment at, or lower than, a temperature at which recrystallization coarsening is initiaated and under a pressure condition which permits obtaining an absolute density.

However, the heat treatment after forging is a consideration. After the forging, the microstructure is extremely fine and it is necessary to coarsen the crystal grain in the rim portion of a turbine disk, etc. by the heat treatment.

Here, it may be possible to coarsen by unidirectional recrystallization heat treatment as is the case with the foregoing method (1), but it is disadvantageous in terms of cost. Rather, it is simple and efficient to coarsen only the rim portion by a one-time solution heat treatment.

Because wof this, the alloy powders are selected by taking into account the states of the hub and rim portions upon solution heat treatment.

With Ni-base superalloys as mentioned above, in order to coarsen the crystal grain, the solution heat treatment is required to be performed at or higher than a temperature at which the gamma prime phase serving as a reinforcing phase becomes a solid solution.

Now, suppose the complete solid solution temperature of a rim material at which its gamma prime phase becomes completely solid solution (hereinafter simply referred to as "complete solid solution temperature" for brevity) is $T_r$, the hub portion is required to be prevented from coarsening and consequently, it is necessary that the complete solid solution temperature $T_h$ of a hub material be higher than $T_r$.

Stated another way, it is necessary to fulfil, as a material selection condition, the relation of $T_r<T_h$. As viewed from the standpoint of the gamma prime phase, this signifies that the hub material used contains more gamma prime crystal than the rim material used.

Inasmuch as the gamma prime crystal content is, in general, increased for the purpose of enhancing creep characteristics, the aforementioned conditional equation is seemingly contrary to this prevailing knowledge.

Figure 2:
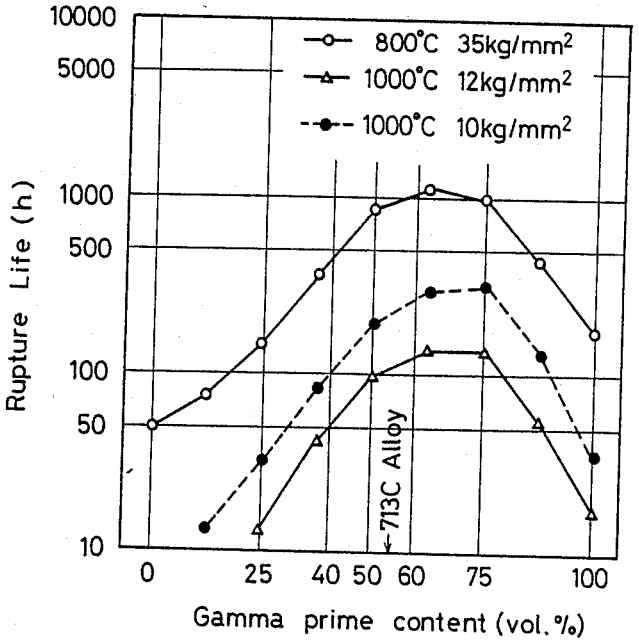
FIG. 2 is a diagram showing a relationship between gamma prime crystal content and creep rupture life.
Figure 3:
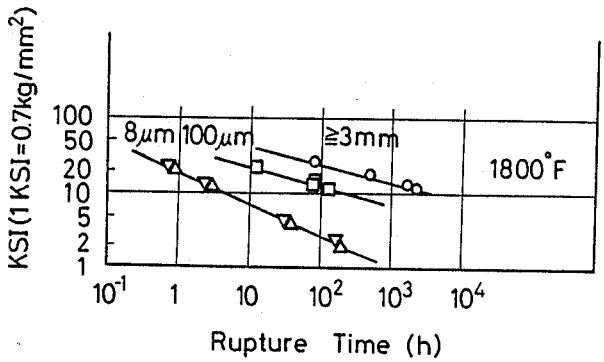
FIG. 3 is a diagram showing an influence of crystal grain diameter on rupture life.

However, an increase of 10% in the gamma prime crytstal content does not raise creep characteristic so much. For example, as FIG. 2 shows a relation between the content of gamma prime crystal and creep rupture life, when the gamma prime content is increased from 40% to 50% or 60%, the creep life is increased to at most about two times. On the other hand, the crystal grain size can be varied easily in the order of 5 to 10 times as is the case with superplasticity forging materials (2−10 μm) and their coarsened ones (20–100 μm) after heat treatment. As a result, the creep life can be increased to 10–50 times as will be apparent from FIG. 3.

Taking into account the temperature control error in the practical heat treatment, the error range being regarded as ±4° C., it is more practical to satisfy the following equation rather than the aforementioned conditional equation: $T_h - T_r \geqq 8°$ C.

In this way, selection of alloy materials are possible.

The materials thus selected are, after HIP treatment or extrusion, subjected to superplasticity forging thereby to junction thoroughly non-junctioned parts at the junction boundary and thereafter, subjected to solution heat treatment at a requisite temperature T fulfilling: $T_r \leqq T < T_h$ thereby to adjust the crystal grain size of the hub and rim portions, whereby a high-performance disk or the like can eventually be fabricated which satisfies various characteristics required for all the portions of the disk or the like.

DESCRIPTION OF THE PREFERRED EMBODIMENTS

Preferred examples of this invention will be hereinafter described.

EXAMPLE 1

Two kinds of alloy powders having compositions given in Table 1 below were chosen.

TABLE 1

| | C | Cr | Co | Mo | W | Al | Ti | B | Zr | Nb | Hf | Ni |
|---|---|---|---|---|---|---|---|---|---|---|---|---|
| Alloy A | 0.07 | 10.8 | 6.9 | 3.1 | 3.4 | 3.9 | 2.8 | 0.01 | 0.05 | 3.9 | — | bal. |
| Alloy B | 0.05 | 10.9 | 14.9 | 2.8 | 5.9 | 3.7 | 3.8 | 0.02 | 0.05 | 1.9 | 0.8 | bal. |

Figure 4:
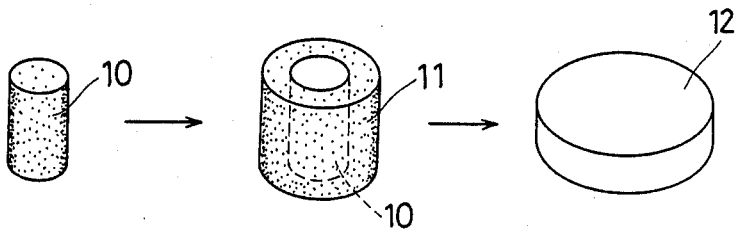
FIG. 4 is a schematic view showing one example of a process for fabricating a material according to this invention.

The alloy powders were submitted to steps as shown in FIG. 4, namely, solidification step of alloy A 10, junction step of alloy A 10 and alloy B 11, and superplasticity forging step. In the solidification step of alloy A 10, HIP treatment was performed under 1050° C.×1800 Kg/cm²×2 h. The solidified alloy A 10 was placed in the central part of a container, and alloy B powder 11 was filled in the peripheral part thereof. Both were junctioned by HIP treatment under 1075° C.×1800 kg/cm²×2 h. The integrated material thus junctioned and solidified was submitted to a superplasticity forging step under conditions of: a temperature of 1080° C., a strain velocity of $2\times10^{-4}$/S, a compression rate of 50%, and a diffusion-junctioned material 12 was obtained.

Then, the junctioned material 12 was further subjected to heat treatment under the conditions of: 1185° C.×2 h/AC+1080° C.×4 h/AC+843° C.×16 h/AC+760° C.×24 h/AC. The metal microstructure at the junction of the resulting product was observed before and after the heat treatment. With the product after the heat treatment, a high temperature tensile test at 650° C. and stress rupture test under 760° C.×60.5 kg/mm² were carried out.

As a result, a junction boundary cannot be seen before the heat treatment after forging, but can be observed clearly after the heat treatment. This is because the two kinds of alloys differ in heat treatment properties and crystal grain size. Further, the heat-treated product shows an extremely sound structure with no defect such as microporosity, crack, etc.

Results of tensile tests and stress rupture tests are shown in Table 2.

TABLE 2

| | Rupture Strength | Rupture Time | Rupture Position |
|---|---|---|---|
| Tensile Test | 160 kg/mm² | — | Alloy B |
| Stress Rupture Test | — | 27.8 h | Alloy A |

As is clear from the tensile above, there occured no rupture at the junction in both tests, and there is no problem at the junction. There is no problem in terms of strength characteristics, either. The alloy A having a fine structure is stronger in the tensile test than alloy B whereas the alloy B having a coarse crystal grain is stronger in the stress rupture test than alloy A.

Thus, it is possible to easily fabricate a high-performance turbine disk, wheel, etc. whose central and peripheral portions differ in characteristics by junctioning different kinds of alloys.

EXAMPLE 2

In order to corroborate effects of this invention, a turbine disk was fabricated in the following procedure.

(i) Selection of Alloy

Alloy A for the hub of a disk: $T_h$=1200° C.

Alloy B for the rim of a disk: $T_r$=1190° C.

Two kinds of the alloys differing in complete solid solution temperature by 10° C. were chosen. Compositions of them are shown in Table 3.

TABLE 3

| | C | Co | Cr | Mo | W | Al | Ti | Nb | B | Zr | Hf | Ni |
|---|---|---|---|---|---|---|---|---|---|---|---|---|
| Alloy A | 0.07 | 6.9 | 10.8 | 3.1 | 3.4 | 3.9 | 2.8 | 3.9 | 0.01 | 0.05 | — | balance |
| Alloy B | 0.05 | 14.9 | 10.9 | 2.8 | 5.9 | 3.71 | 3.81 | 1.86 | 0.02 | 0.05 | 0.8 | balance |

(ii) Fabrication of Material

The alloy powder B of 150 mesh and a particle diameter of up to 105 μm was sealed in a stainless container of 100 mm in diameter and HIP-treated under 1050°

C.×1800 kg/cm²×2 h to produce a HIP-solidified material for the rim portion.

A cylinder body having an outside diameter of 85 mm and an inside diameter of 65 mm was formed from the HIP material and placed in a stainless container. The alloy powder A was filled and sealed within the central part of the cylinder and subjected to HIP treatment under the same conditions as above so that superplasticity may be obtained.

From the 2nd HIP material thus obtained, a forging material having a size of 78 mm in diameter and 50 mm in height was fabricated.

(iii) Superplasticity Forging and Heat Treatment

The aforesaid forging material was subjected to superplasticity forging with the aid of a forging press of 400 tons at 1080° C. at a strain velocity of $5\times10^{-4}$/S and pressed down from 50 mm to 20 mm in height, and then subjected to heat treatment under 1190° C.×2 h/AC+760° C.×16 h/AC. A required disk was thus obtained.

(iv) Tests

The disk obtained was tested for the items below.

Test Items:

Tensile test including the junction boundary.

Stress rupture test and tensile test of the rim portion (alloy B).

Tensile test of the hub portion (alloy A).

Test specimens having a length of 20 mm and a diameter of 6 mm were used.

Test conditions were: for tensile test: 760° C., a strain velocity of 0.05%/S, for stress rupture test: 760° C.×60.5 kg/mm².

(v) Test Results

The microstructures of the rim and hub portions were observed on photomicrograph and as a result, it was proved that alloy B of the rim is coarsened to a crystal grain diameter on the order of 30 μm owing to the solution heat treatment at 1190° C.

On the other hand, crystal grain diameter of not more than 10 μm was obtained in the hub portion.

Thus, in accordance with this invention the intended object was achieved from the standpoint of microstructure.

Results of tensile test are shown in Table 4 below.

TABLE 4

| No. | Specimen sampled from | Tensile strength (kg/mm²) | Elongation (%) |
|---|---|---|---|
| 1 | Hub | 128 | 17 |
| 2 | Hub + Rim | 121 | 7 |
| 3 | Rim | 120 | 7 |

As will be apparent from Table 4, the hub, the central portion of the disk, is superior, in strength and elongation, to the rim, the peripheral portion of disk, because of its fine structure. The test on the specimen (No. 2) including the hub and rims shows that the overall strength depends on the strength of the rim. The specimen (No. 2) was fractured in the alloy B of the rim, and no change was observed at the junction.

As a result of the stress rupture test, the life of the specimen (No. 2) was 290 hr. For comparison purposes, the alloy A was coarsened likewise and underwent the stress rupture test under the same condition, and 98 hrs of stress rupture life resulted.

Thus, augmentation in stress rupture life is obtained.

EXAMPLE 3

In order to corroborate superplasticity characteristics and junctioning properties between different alloys in this invention, further tests were conducted.

(i) Test Method

In performing the tests, the chemical compositions of the alloys chosen and combinations of the alloys in the hub and rim of each disk are shown in Table 5 and Table 6, respectively.

TABLE 5

| | C | Cr | Co | Mo | W | Al | Ti | V | B | Zr | Hf | Nb | Ni |
|---|---|---|---|---|---|---|---|---|---|---|---|---|---|
| Alloy A | 0.07 | 10.8 | 6.9 | 3.1 | 3.4 | 3.9 | 2.8 | — | 0.01 | 0.05 | — | 3.9 | bal. |
| Rene 95 | 0.05 | 12.9 | 8.3 | 3.5 | 3.4 | 3.6 | 2.5 | — | — | 0.04 | — | 3.5 | bal. |
| Alloy B | 0.05 | 10.9 | 14.9 | 2.8 | 5.9 | 3.7 | 3.8 | — | 0.018 | 0.05 | 0.8 | 1.9 | bal. |
| Mod. IN 100 | 0.07 | 12.4 | 18.5 | 3.2 | — | 4.3 | 5.0 | 0.8 | 0.020 | 0.06 | — | — | bal. |

TABLE 6

| Combination | Hub × Rim | Solution Heat Treatment Temp. |
|---|---|---|
| 1 | Alloy A × Rene 95 | 1160–1200° C. |
| 2 | Alloy A × Alloy B | 1170–1200° C. |
| 3 | Mod. 100 × Alloy B | 1170–1180° C. |

Figure 5A:
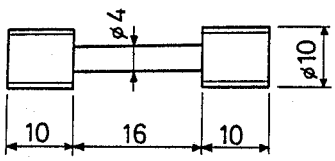
FIG. 5(*a*) and FIG. 5(*b*) are each a schematic illustration showing the shape of a test specimen.
Figure 5B:
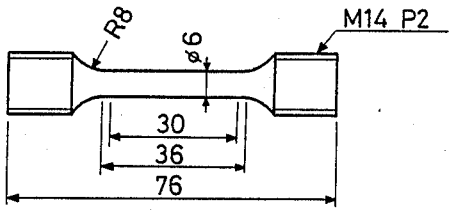

The test specimens were formed in the shapes as illustrated in FIG. 5(*a*) and FIG. 5(*b*). The specimen in FIG. 5(*a*) is for the superplasticity tensile test and the specimen in FIG. 5(*b*) is for the high temperature tensile test and the stress rupture test.

By the use of these specimens, the junctioning properties upon production of a forging material, the superplasticity characteristics of the forging material, the joint strength after heat treatment, etc. were investigated by the superplasticity tensile test, the high temperature tensile test, etc.

Figure 6:
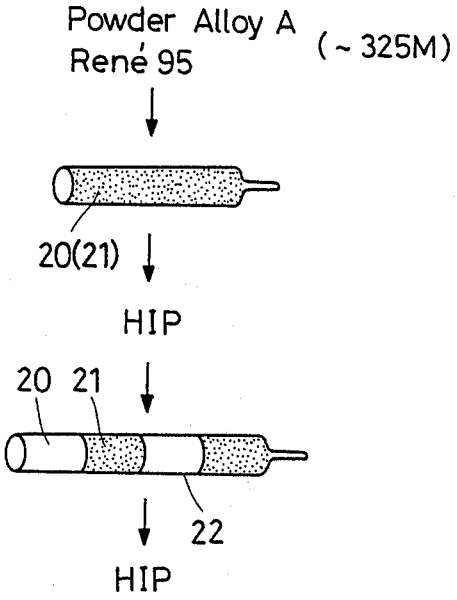
FIG. 6 is a schematic view of another example of a process for fabricating a material in this invention.

A series of steps of fabricating test specimens by combining alloy A and René 95 are illustrated in FIG. 6. The process of fabrication will be described hereinbelow with reference to FIG. 6.

First, an alloy powder material such as alloy A or René 95 (~325M) 21 was solidified by HIP under 1050° C.×1800 kg/cm²×2 h. To the HIP solidified material, a different kind of alloy powder, namely, René 95 powder for alloy A and alloy A powder for René 95, was junctioned in solid phase by HIP.

The HIP material used here was in the form of a column of 16 mm in diameter and 50 mm in length as illustrated in FIG. 6 and its junction faces were finished by buff grinding, and cleaning with water and ethyl alcohol. Then, the material and the other alloy powder were charged alternately and sealed in a stainless pipe having an inside diameter of 18.4 mm to make a capsule 22.

The 2nd HIP condition is desirable to be a high temperature as far as possible in terms of solid phase junction ability, but should also be taken account of the necessity of preventing the crystal grain from coarsening in terms of the subsequent superplasticity capability. For these reasons, a temperature range between 1050° C. and 1100° C. was investigated. The other conditions were 1800 kg/cm$^2$ and 2 hr.

In order to evaluate the junctioning properties and superplasticity of the thus-obtained materials, the superplasticity tensile test, the high temperature tensile test at 760° C. and the stress rupture test were carried out.

In these tests, solution heat treatment was carried out at 1180° C.

Further, other combinations of alloys shown in Table 6 (No. 2, 3) were subjected to solid phase junctioning under the same conditions to give HIP junctioned materials. With these materials, the solution treatment temperature was 1185° C. for the combination of alloy A and alloy B and 1175° C. for the combination of Mod. IN 100 and alloy B. The materials thus obtained were likewise submitted to the foregoing tests.

Throughout all the test specimens, the superplasticity tensile test was conducted at 1100° C., at initial strain velocity of $2\times10^{-4}$/S, wherein specimens were elongated up to an elongation of 200%, with the cross-head speed kept constant. The high temperature tensile test was carried out at 760° C. and the stress rupture test was carried out under 760° C.×60.5 kg/mm$^2$.

(ii) Test Results (a) Superplasticity test results are shown in Table 7.

TABLE 7

| Alloy Hub × Rim | 2nd HIP Temp. (°C.) | Elongation (%) Hub | Elongation (%) Rim | Rupture Position |
|---|---|---|---|---|
| Alloy A × Rene 95 | 1050 | 56 | 156 | Junction |
| Alloy A × Rene 95 | 1100 | 38 | 187 | Rene 95 |
| Alloy A × Alloy B | 1075 | 163 | 225 | None |
| Alloy A × Alloy B | 1125 | 181 | 220 | None |
| Mod. IN 100 × Alloy B | 1075 | 13 | 400 | None |

With the combination of alloy A and René 95 wherein the 2nd HIP temperature is 1050° C., an average elongation of 106% was obtained, but the junction was ruptured. It was observed that the diameter of the specimen in its elongated length portion is changed abruptly at the junction since alloy A and René 95 differ in elongation rate because of the difference in superplasticity characteristics.

In the case of the same combination where the 2nd HIP temperature is 1100° C. René 95 was fractured. This fracture occurs with a relatively small overall elongation of 113%.

On the other hand, the combinations of alloy A and alloy B and of Mod. IN 100 and alloy B does not cause rupture even at 200% elongation. Particularly, the former exhibits near elongations between alloy A and alloy B, which suggests that both alloys have similar superplasticity characteristics. However, the latter exhibits an extremely small elongation on the Mod. IN 100 side. According to our investigation of this alloy, this is because its fine crystal again produced by HIP at 1075° C. begins to coarsen during the superplasticity test with the result that the deformation resistance is heightened.

(b) Results of high temperature tensile test at 760° C. are shown in Table 8.

TABLE 8

| Alloy Hub × Rim | 2nd HIP Temp. (°C.) | Tensile Strength (kg/mm$^2$) | Elongation (%) | Rupture Position |
|---|---|---|---|---|
| Alloy A × Rene 95 | 1050 | 101.7 | 2.5 | Alloy A |
| Alloy A × Rene 95 | 1100 | 101.7 | 2.5 | Alloy A |
| Alloy A × Alloy B | 1075 | 111.6 | 5.0 | Alloy A |
| Mod. IN 100 × Alloy B | 1075 | 107.4 | 4.5 | Junction |

As will be apparent from Table 8 above, only the combination of Mod. IN 100 and alloy B causes rupture at the junction. All the other combinations cause rupture at alloy A.

The highest tensile strength and elongation are obtained with the combination of alloy A and alloy B.

From the results listed above, the combination of alloy A and alloy B is proved to have no problem at all in terms of junction ability upon manufacturing a forging material and of the superplasticity forgeabillity of it. Further, it is apparent that the HIP temperature range of 1050° C.–1150° C. upon manufacturing a forging material is not problematic in terms of junction ability and forgeability.

(c) Further results of the stress rupture test are shown in Table 9.

TABLE 9

| Alloy Hub × Rim | 2nd HIP Temp. (°C.) | Rupture Time (hr) | Rupture Position |
|---|---|---|---|
| Alloy A × Rene 95 | 1050 | 11.1 | Alloy A |
| A11oy A × Rene 95 | 1100 | 8.5 | Alloy A |
| Alloy A × Alloy B | 1075 | 27.8 | Alloy A |
| Mod. IN 100 × Alloy B | 1075 | 10.8 | Junction |

According to Table 9, all the combinations are ruptured at alloy A except for the combination of Mod. IN 100 and alloy B which is ruptured at the junction.

The rupture at alloy A is inferred to be due to the fact that the microstructure of alloy A is of fine crystal grain.

The longest rupture life is obtained with the combination of alloy A and alloy B. This is considered to be due to the fact that since the solution heat treatment temperature is higher than that of the combination of alloy A and René 95, crystal grain of alloy A was a little coarsened.

Thus, it can be understood that the combination of alloy A and alloy B is superior in terms of all-around properties including junction ability, superplasticity, strength characteristics, etc.

As thus far described, according to this invention, different kinds of alloys are junctioned and subjected to superplasticity forging thereby to secure reliability at the junction boundary faces. As a consequence, it is possible to enhance performances of heat-resistant heavy-duty members such as a turbine disk, wheel, etc. for which different characteristics are required depending on their portions. Such high-performance members that cannot be realized with a single alloy can be fabricated. Particularly, according to this invention, it is possible to fabricate a high-performance turbine disk, etc. whose hub has a fine structure and is superior in tensile characteristics and has low cycle fatigue characteristics and whose rim is of coarse crystal grain and superior in creep characteristics by conventional heat treatment and superplasticity forging which serves to augment the reliability at the junction.

Fabrication of such a dual property disk, etc. is enabled by selection of different kinds of superalloys fulfilling the requisite characteristics for the hub and rim portions, at a low cost. Further, the disk or the like thus fabricated can exhibit good performance under severe service conditions. Eventually, such advantages of heat-resistant heavy-duty members according to this invention contribute to improvement in performances of gas turbines.

We claim:

1. A method of fabricating heat-resistant heavy-duty components of a turbine wherein different kinds of alloys are junctioned, by superplasticity forging, which comprises selecting different kinds of alloy powders which are superplasticity forgeable and have different complete solid solution temperatures of gamma prime phase for use in the hub and rim portions of said components so that the one alloy powder having a higher temperature of said complete solid solution temperature may be disposed for the hub portion and the other alloy powder for the rim portion;

preliminarily solidifying the one alloy powder of the one portion of said hub and rim portions by hot isostatic pressing or extrusion;

filling and sealing the other portion with the other alloy powder and junctioning and solidifying it with the solidified portion by hot isostatic pressing or extrusion;

subsequently, subjecting both portions thus solidified and junctioned to superplasticity forging; and further subjecting both portions to solution heat treatment at a temperature between said complete solid solution temperatures of alloy powders thereby to adjust the crystal grain size of them, wherein said alloy powder for the hub and said alloy powder for the rim are alloy A and alloy B, respectively, having respective compositions listed below:

| Element | Alloy A (HUB) | Alloy B (Rim) |
|---|---|---|
| C | 0.09–0.02 | 0.07–0.02 |
| Cr | 8–12 | 8–12 |
| Co | 6–9 | 13–17 |
| Mo | 1.5–4.5 | 1.5–4.5 |
| W | 2.5–4.5 | 4.5–7.5 |
| Al | 2.8–4.8 | 2.8–4.8 |
| Ti | 1.8–3.8 | 2.8–4.8 |
| Nb | 2.9–4.9 | 1–3 |
| Hf | — | <1.0 |
| B | <0.05 | <0.05 |
| Zr | <0.10 | <0.10 |
| Ni | balance | balance |

* * * * *

UNITED STATES PATENT AND TRADEMARK OFFICE

CERTIFICATE OF CORRECTION

PATENT NO. : 4,825,522

DATED : May 2, 1989

INVENTOR(S) : IWAI ET AL

It is certified that error appears in the above-identified patent and that said Letters Patent is hereby corrected as shown below:

Column 1, line 15, after "different" insert --characteristics--.

Column 4, line 34, delete "superplasicity" and insert --superplasticity--;

line 37, delete "initiaated" and insert --initiated--;

line 50, delete "wof" and insert --of--.

Column 6, line 29, delete "tensile" and insert --results--.

Signed and Sealed this

Twenty-fourth Day of December, 1991

*Attest:*

HARRY F. MANBECK, JR.

*Attesting Officer*

*Commissioner of Patents and Trademarks*